United States Patent [19]

Garro

[11] Patent Number: 4,660,396

[45] Date of Patent: Apr. 28, 1987

[54] LOCK SYSTEM

[75] Inventor: Jose I. P. Garro, Escoriaza, Spain

[73] Assignee: Talleres de Escoriaza, S.A., Guipuzcoa, Spain

[21] Appl. No.: 545,084

[22] Filed: Oct. 25, 1983

[30] Foreign Application Priority Data

Oct. 25, 1982 [ES] Spain ..... 516806

[51] Int. Cl.[4] ..... E05B 27/06

[52] U.S. Cl. ..... 70/358; 70/364 A

[58] Field of Search ..... 70/358, 359, 364 A, 70/376, DIG. 52, DIG. 53, DIG. 54, DIG. 55, 378, 392, 419, 421

[56] References Cited

U.S. PATENT DOCUMENTS

| | | | |
|---|---|---|---|
| 1,113,193 | 10/1914 | Carroll | 70/364 A |
| 1,172,203 | 2/1916 | Fuller | 70/421 |
| 1,509,594 | 9/1924 | Freysinger | 70/364 A |
| 1,675,737 | 7/1928 | Teich | 70/364 A |
| 3,293,892 | 12/1966 | Falk | 70/358 |
| 3,590,615 | 7/1971 | Schultz | 70/358 X |
| 3,777,520 | 12/1973 | Crepinsek | 70/358 |
| 4,111,019 | 9/1978 | Rabinow | 70/358 |
| 4,142,389 | 3/1979 | Bahry et al. | 70/359 |
| 4,270,372 | 6/1981 | Vonlanthen et al. | 70/406 |

FOREIGN PATENT DOCUMENTS

| | | | |
|---|---|---|---|
| 690883 | 5/1940 | Fed. Rep. of Germany | 70/358 |
| 2014049 | 10/1971 | Fed. Rep. of Germany | 70/358 |
| 2204780 | 8/1973 | Fed. Rep. of Germany | 70/358 |

*Primary Examiner*—Gary L. Smith
*Assistant Examiner*—Lloyd A. Gall
*Attorney, Agent, or Firm*—Laff, Whitesel, Conte & Saret

[57] ABSTRACT

The present invention relates to a lock which features projections located in a single plane of the rotor and stator lined into two opposing rows. The drillings for the main group of projections and their corresponding springs extend through the rotor to the opposite side of the frame or stator but not through it completely. This blind drilling forms the exact lodging for an antagonistic second set of projections and springs.

8 Claims, 5 Drawing Figures

Fig 4
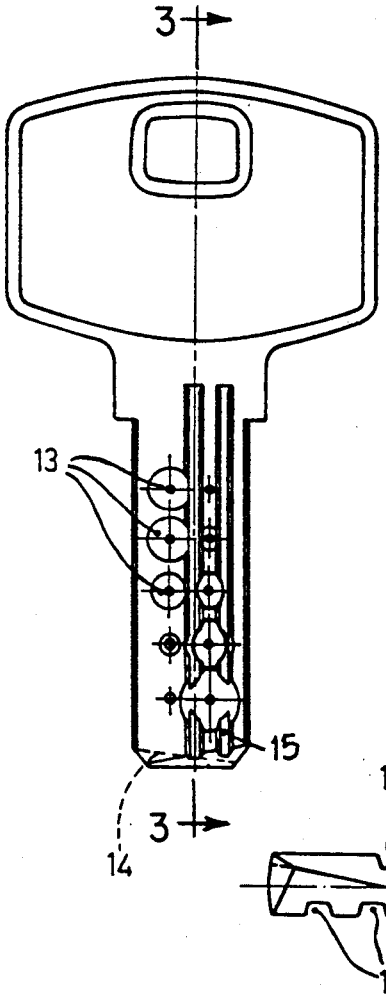
Fig 3
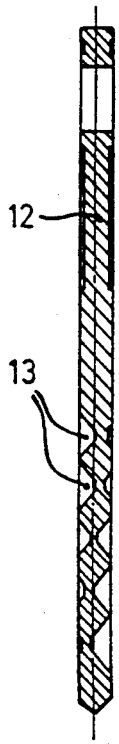
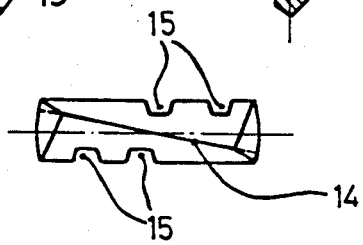
Fig 5

LOCK SYSTEM

BACKGROUND OF THE INVENTION

1. Field of the Invention

The present invention relates to key locks. In particular, the present invention relates to an improved design for a key lock which provides a reversible flat key.

2. Brief Description of the Prior Art

The basic mechanism of most prior art lock cylinders consists of transverse projections displaced by insertion of the key thereby allowing rotation of the lock cylinder. It is the displacement which puts the projections in a position that permits the free rotation of the lock cylinder. There are several lock cylinders known, among which include those using "flat" keys featuring varying numbers of surface depressions of precise depths and shapes. These depressions make an accurate displacement of the projections possible as well as a large number of permutations which make them very efficient as keys.

The number of possible different combinations for a lock cylinder is determined by the number of projections and by the number of different positions which those projections may take. In theory the number of positions could be infinite, but in practice the number is limited because of the level of precision which is economical and because of the necessary play which the component elements must provide for dependable lock function.

In a flat key, the maximum variation in the positions of the projections is determined by the size of the key section. When a reversible key is used the maximum variation in the positions of the projections is reduced by one-half. This is because the tread of the sides cannot exceed one-half of the section, since the key must be reversible. To overcome this limitation prior art keys have radially placed rows of projections in the slopes. In other words, there were more than one set of projections in an angular distribution along the key.

Although this increased the possible number of combinations, it also complicated greatly the production of the lock by making it necessary to drill the lock rotor and stator in distinct steps for each set of projections. It was also necessary to assemble each projection separately and it was found that obtaining a reversible key proved to be extremely difficult.

SUMMARY OF THE INVENTION

It is an object of the present invention to provide a lock with at least two sets of projections which may be produced in a single drilling step.

It is another object of the present invention to provide a lock with at least two sets of projections which remain in a fixed, static position.

It is a further object of the present invention to provide a lock with at least two sets of projections, one of which is an axial extension of the other.

It is an object of the present invention to provide a lock with at least two sets of projections requiring only one set of closing elements.

It is an object of the present invention to provide a lock with a flat, reversible key which makes use of more than one-half of the key stem section.

These objects and others are provided by a novel device which features projections located in a single plane of the lock rotor and stator. The projections are lined into two opposing rows. The drillings for the main group of projections and their corresponding springs extend through the rotor to the opposite side of the frame or stator but not through it completely. This blind drilling forms the exact lodging for an antagonistic second set of projections and springs.

According to the present invention, when the key is inserted into the rotor, both groups of projections move in opposite directions into a position in which rotation of the rotor is permitted. However, when the key is not inserted into the rotor the opposing projections are in contact under their respective spring pressure. Their contact point is located inside the key entry channel.

In order for the contact point of the projections to remain in the key entry channel, the lock provides that the main group of projections is limited in displacement so that its deepest penetration into the rotor locates its tips in the key entry channel. The lock also provides that the springs biasing the main group of projections are stronger than those biasing the second group. Therefore, the main group of projections occupies the limit position which necessarily locates the contact points in the key entry channel.

The above-described action of the main group of projections is easily obtained without complicated or excessively repetitive fabrication steps.

Additionally, to facilitate the key's entrance into the rotor, the key may include longitudinal grooves forming a reversible cross section. The cross section is adapted to the shape of the entry channel thereby providing an additional permutations of keys. These grooves also facilitate the correct positioning of the key tread by working as guides and make possible an extension of the wall, helping determine the placement of the projections.

BRIEF DESCRIPTION OF THE DRAWINGS

To aid the illustration and understanding of the invention, the following drawings have been provided, of which:

FIG. 3 is a sectional view of a key used in the present invention taken generally along the line 3—3 of FIG. 4;

FIG. 4 is a plan view of the key used in the present invention; and

FIG. 5 is an elevation view of the tip of the key illustrated in FIG. 4.

DETAILED DESCRIPTION OF THE INVENTION

Figure 2:
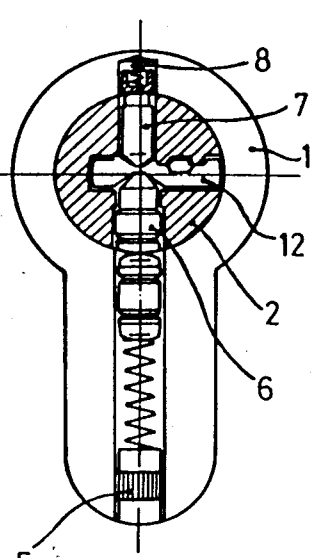
FIG. 2 is a sectional view of the present invention taken generally along the line 2—2 of FIG. 1.
Figure 1:
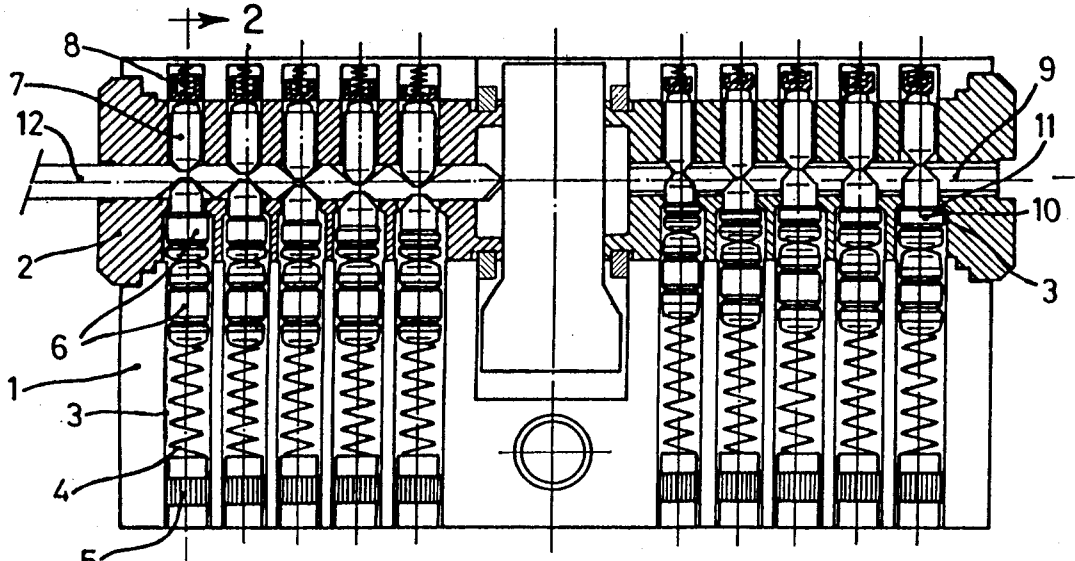
FIG. 1 is an elevated sectional view of the present invention taken generally through its median plane.

A preferred embodiment of the present invention is seen illustrated in FIGS. 1 and 2. Generally, the improved lock system includes an external frame or stator, 1 and an internal rotor 2 capable of rotation therein. The assembly, as may be best seen in FIG. 1, features a series of blind drillings 3 through a part of the stator 1, rotor 2 and partially through the wall of stator 1 opposite from the point at which the drillings 3 began.

Small transverse elements are inserted into drillings 3. The elements, which have a generally cylindrical shape, prevent the displacement of rotor 2 with respect to stator 1 in the absence of key 12. The elements are formed inside each drilling 3 by a grouping of main projections 6 and a second grouping of projections 7. Each grouping 6, 7 is inwardly biased by its respective spring 4, 8 thereby permitting projections 6, 7 to be simultaneously operated by both sides of key 12. It should be clear from the above explanation and the FIGS. relating thereto that the lock thus far described requires only a blind drilling 3 which can be obtained in a single drilling step for both stator 1 and rotor 2. The assembly of the individual lock elements, which include projections 6, 7 and springs 4, 8, is completed by the insertion of lid or cap 5.

In FIG. 1, it is seen that main projections 6 and secondary projections 7 are positioned in depressions 13 of key 12 which is partially inserted into the lock. The posterior edges of projections 6, 7 are flush with the surface of rotor 2 thereby allowing rotor 2 to rotate relative to stator 1. When key 12 is withdrawn main projections 6 and secondary projections 7 come into contact as described previously under the action of springs 4, 8 respectively.

Upon reinserting key 12 into rotor 2, main projections 6 are again separated from secondary projections 7. In this manner projections 6, 7 each work on the wider faces of key 12. Additionally, it is desirable that main projections 6 are arranged within channel 9 in the above manner and that the spring 4 of projection 6 will have greater power than spring 8 corresponding to secondary projection 7. In this manner projection 6 overpowers projection 7, consistently occupies the maximum exit position within channel 9 and maintains contact with projections 7. In the preferred embodiment, the projections are shaped as truncated cones with the contact points between projections being located inside channel 9 of the key entry. Therefore, a frontally oriented bevel 14 provided by key 12 will operate as a wedge separating projections 6, 7.

These conditions are obtained by causing drilling 3 to present a stepped diameter which is reduced at a predefined point thereby forming stop 11. Stop 11 may be provided without altering either the ease of machining or the simple assembly of projections 6 and 7. As may be best seen in FIGS. 1 and 2, the main projections 6 also present a step 10 in their diameter. Step 10 is adapted to come into contact with stop 11 and thereby limit the run of the main projections 6 when key 12 is withdrawn from rotor 2.

Preferably, for ease of machining, the distance between step 10 of each main projection 6 and its free end should be the same for eacn of projections 6. However, if a particularly difficult lock to "pick" is desired, the distance between steps 10 and the free end of projections 6 may be varied. In other words, even though the points of encounter between individual pairs of projections 6 and 7 are always constant, they may themselves be either lined up or disaligned. In either event, the distance will be determined by the necessity to locate the ends of projections 6 within channel 9 for key 12 operation.

Main projection 6, which presents a stepped diameter with a posterior part having a diameter larger than both its end and the diameter of its projection 7, offers an additional advantage. That is, when key 12 and rotor 2 have completed one-half rotation, the differences in diameters precludes main projections 6 from displacing spring 8 by penetrating into the bottom of drillings 3 which would permit the withdrawal of key 12. Therefore, the above-described arrangement ensures that only a single exit position for key 12 is provided.

As may be best seen in FIGS. 3 and 4, key 12 features depressions 13 arranged in parallel rows. Since key 12 is reversible by being capable of entering and operating the lock in both positions, depressions 13 are located on both working faces. Preferentially, to better guide and align key 12 into the lock, grooves 15 are longitudinally oriented in each face of key 12. Grooves 15 are adapted to the shape of entry channel 9 and provide an additional element to key 12 which increases the number of different combinations and the safety of the lock unit. The grooves 15 further make possible an extension of the key walls which determine the lodging of projections 6 and 7, while still improving the guiding of same.

Thus, a lock has been taught with a reversible key 12. Key 12 preferentially provides a bevel element 14 at its tip causing the separation between the main projections 6 and the secondary projections 7. Bevel 14, as it may be seen in FIG. 5 is shaped by the intersection of two inclined planes which is especially effective and particularly easy to manufacture. The planes cut each other in an edge which approximates the diagonal of the rectangular section of the stem of key 12. The bevel may be complemented by an end formation such as a chamfer which further facilitates the initial entry of key 12.

While a preferred embodiment of the present invention has been described and illustrated, further modifications may be made hereto which fall within both the spirit and scope of the invention. It is intended, therefore, that any such modifications and their equivalents will be covered by the claims following hereunder.

What is claimed is:

1. A lock assembly for flat reversible keys comprising at least one key plug for a flat reversible key mounted for rotation in a lock cylinder, said key plug defining a key slot and a plurality of diametric passages extending through said key slot;

each of the key plug diametric passages having a first and second aligned radial passage;

a plurality of cylinder passages defined by said lock cylinder, said cylinder passages being aligned with said second radial passages, a plurality of holes having a closed end being defined by said cylinder, said holes being diametrically opposite the cylinder passages and being aligned with said first radial passages;

a first set of tumblers movably contained in said first key plug passages and having a cooperating spring means mounted in the cylinder holes, said first set of tumblers being sized to pass through the cylinder passages and said key plug passages;

a second set of tumblers movably located in said second key plug passages and said second key plug passages having stop means to prevent said tumblers from passing through said second key plug passages, cylinder passage spring means mounted in said cylinder passages and cooperating with said second tumblers, said cylinder passage spring means having a greater strength than the cylinder hole spring means and said first and second tumblers and their cooperating springs being sized such that the ends of the first and second tumblers will contact each other when the key slot is empty.

2. The lock assembly of claim 1 comprising a removable cover mounted in each cylinder passage whereby each tumbler may be removed without disturbing the remaining tumblers.

3. The lock assembly of claim 2 wherein there are two key plugs and each key plug is one piece and said lock cylinder being one piece.

4. The lock assembly of claim 3 wherein the key slot has longitudinally extending grooves.

5. The lock assembly of claim 4 wherein the key plug passages and tumblers are sized and positioned to permit a flat reversible key to operate the lock assembly.

6. The lock assembly of claim 1 wherein there are two key plugs and each key plug is one piece and said lock cylinder being one piece.

7. The lock assembly of claim 1 wherein the key slot has longitudinally extending grooves.

8. The lock assembly of claim 1 wherein the key plug passages and tumblers are sized and positioned to permit a flat reversible key to operate the lock assembly.

* * * * *